US011008901B1

(12) United States Patent
Hattiangadi et al.

(10) Patent No.: US 11,008,901 B1
(45) Date of Patent: May 18, 2021

(54) ROCKER ARM ASSEMBLY WITH AIR VENTING

(71) Applicant: Caterpillar Inc., Peoria, IL (US)

(72) Inventors: Ashwin A. Hattiangadi, Edwards, IL (US); Charles F. Coffey, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/692,476

(22) Filed: Nov. 22, 2019

(51) Int. Cl.
*F01L 1/24* (2006.01)

(52) U.S. Cl.
CPC ..... *F01L 1/2416* (2013.01)

(58) Field of Classification Search
CPC ..... F01L 13/06; F01L 13/065; F01L 1/2411; F01L 1/20; F01L 2001/2444; F01L 2810/02; F01L 1/2416; F01L 1/24; F02D 13/04
USPC ..... 123/90.16, 90.39, 90.46, 90.45
See application file for complete search history.

(56) References Cited

U.S. PATENT DOCUMENTS

| | | | | |
|---|---|---|---|---|
| 4,523,551 | A | 6/1985 | Arai et al. | |
| 6,354,254 | B1 * | 3/2002 | Usko | F02D 13/04 123/90.16 |
| 7,909,017 | B2 | 3/2011 | Yang | |
| 8,578,901 | B2 | 11/2013 | Ruggiero et al. | |
| 9,309,788 | B2 * | 4/2016 | Nair | F01L 1/26 |
| 2011/0017161 | A1 | 1/2011 | Yasui et al. | |
| 2016/0273415 | A1 | 9/2016 | Kizhakkethara et al. | |

FOREIGN PATENT DOCUMENTS

| | | | | |
|---|---|---|---|---|
| CN | 104975898 | B | 9/2017 | |
| CN | 109139169 | A | 1/2019 | |
| DE | 102013200167 | A1 * | 7/2014 | F01L 1/20 |
| JP | 4089313 | B2 | 5/2008 | |
| JP | 2010048124 | A * | 3/2010 | |
| KR | 101683529 | B1 | 12/2016 | |
| WO | WO-2004081352 | A1 * | 9/2004 | F01L 13/06 |

OTHER PUBLICATIONS

JP-2010048124-A, Mar. 2010, English Language Machine Translation.*
DE-102013200167-A1, Jul. 2014, English Language Machine Translation.*

* cited by examiner

*Primary Examiner* — Patrick Hamo
*Assistant Examiner* — Wesley G Harris
(74) *Attorney, Agent, or Firm* — Oblon, McClelland, Maier & Neustadt

(57) ABSTRACT

A rocker arm assembly having a rocker arm with a first end defining a first cavity, a second end opposite the first end, a bore positioned between the first end and the second end for pivotally mounting the rocker arm within an engine, and an oil passage extending from the bore to the cavity. A hydraulic lash adjuster is positioned within the cavity and has an oil inlet in fluid communication with the oil passage. The rocker arm has a vent passage configured to place the oil inlet in fluid communication with an area exterior to the rocker arm.

7 Claims, 5 Drawing Sheets

ROCKER ARM ASSEMBLY WITH AIR VENTING

TECHNICAL FIELD

This disclosure relates to a rocker arm assembly for an engine, and in particular, to a rocker arm assembly having a hydraulic lash adjuster and air venting.

BACKGROUND

Internal combustion engines typically utilize valve actuation systems to control the flow of fuel and air to one or more combustion chambers during operation. Valve actuation systems may include a variety of components, such as for example, one or more rotating camshafts, cam followers, push rods, rocker arms, and other elements disposed in a valvetrain to transfer the motion from the camshaft to the valves. Lash adjustment features are typically provided on valve actuation systems to eliminate lash, which is the mechanical clearance between valvetrain components.

One type of lash adjustment feature is a hydraulic lash adjuster ("HLA"). HLAs typically includes mechanical components that cooperate to expand under hydraulic pressure to eliminate lash during one portion of the valve cycle, typically when the valvetrain is under low load or unloaded, and then assume a hydraulically "locked" or incompressible state during another portion of the valve cycle, typically when the valvetrain is under high load. HLAs may be incorporated, for example, in the rocker arm design. U.S. Pat. No. 4,523,551, to Arai et al., for example, discloses a valve actuating device for an internal combustion engine having a cam and a valve stem that includes a hydraulic valve lifter slidably disposed in the end of a rocker arm, a hollow rocker arm shaft pivotally supporting the rocker arm, a first fluid supply passage formed in the rocker arm shaft, a second fluid supply passage formed in the rocker arm to supply the hydraulic valve lifter with oil.

HLAs require high oil pressure at the HLA inlet to effectively operate. Air, however, may be trapped in the oil during some operating conditions, such as during start-up and start-stop conditions. The trapped air may lead to HLA malfunction leading to high valvetrain dynamics and eventually failure.

SUMMARY

In accordance with one aspect of the present disclosure, a rocker arm assembly includes a rocker arm having a first end defining a first cavity, a second end opposite the first end, a bore positioned between the first end and the second end for pivotally mounting the rocker arm within the engine, and an oil passage extending from the bore to the cavity. The rocker arm assembly further including a hydraulic lash adjuster positioned within the cavity, the hydraulic lash adjuster having an oil inlet in fluid communication with the oil passage. The rocker arm further includes a vent passage configured to place the oil inlet in fluid communication with an area exterior to the rocker arm.

In accordance with another aspect of the present disclosure, a valve actuation system for an internal combustion engine includes a camshaft rotatably mounted within the engine, a rocker arm having a first end defining a first cavity, a second end opposite the first end, a bore positioned between the first end and the second end, and an oil passage extending from the bore to the cavity, one or more engine valves reciprocally mounted within the engine, wherein the first end of the rocker arm is operatively coupled to the engine valves, and a rocker shaft received in the bore to pivotably mount the rocker arm onto the rocker shaft. The valve actuation system further including a hydraulic lash adjuster positioned within the cavity, the hydraulic lash adjuster having an oil inlet in fluid communication with the oil passage. The rocker arm further includes a vent passage configured to place the oil inlet in fluid communication with an area exterior to the rocker arm.

In accordance with another aspect of the present disclosure, a method of venting air from oil delivered to a hydraulic lash adjuster on an engine includes delivering oil from an oil pump of the engine to the inlet area of the hydraulic lash adjuster via a first oil passage in the rocker arm and routing a portion of the oil from the inlet area through a vent passage extending from the inlet area to an area exterior to the rocker arm, wherein air entrapped in the oil is vented from the inlet area of the hydraulic lash adjuster.

BRIEF DESCRIPTION OF THE DRAWINGS

Further features and advantages will be evident from the following illustrative embodiment which will now be described, purely by way of example and without limitation to the scope of the claims, and with reference to the accompanying drawings, in which:

DETAILED DESCRIPTION

While the present disclosure describes certain embodiments of a rocker arm assembly used in a valve actuation system for an internal combustion engine, the present disclosure is to be considered exemplary and is not intended to be limited to the disclosed embodiments. Also, certain elements or features of embodiments disclosed herein are not limited to a particular embodiment, but instead apply to all embodiments of the present disclosure.

Figure 1:
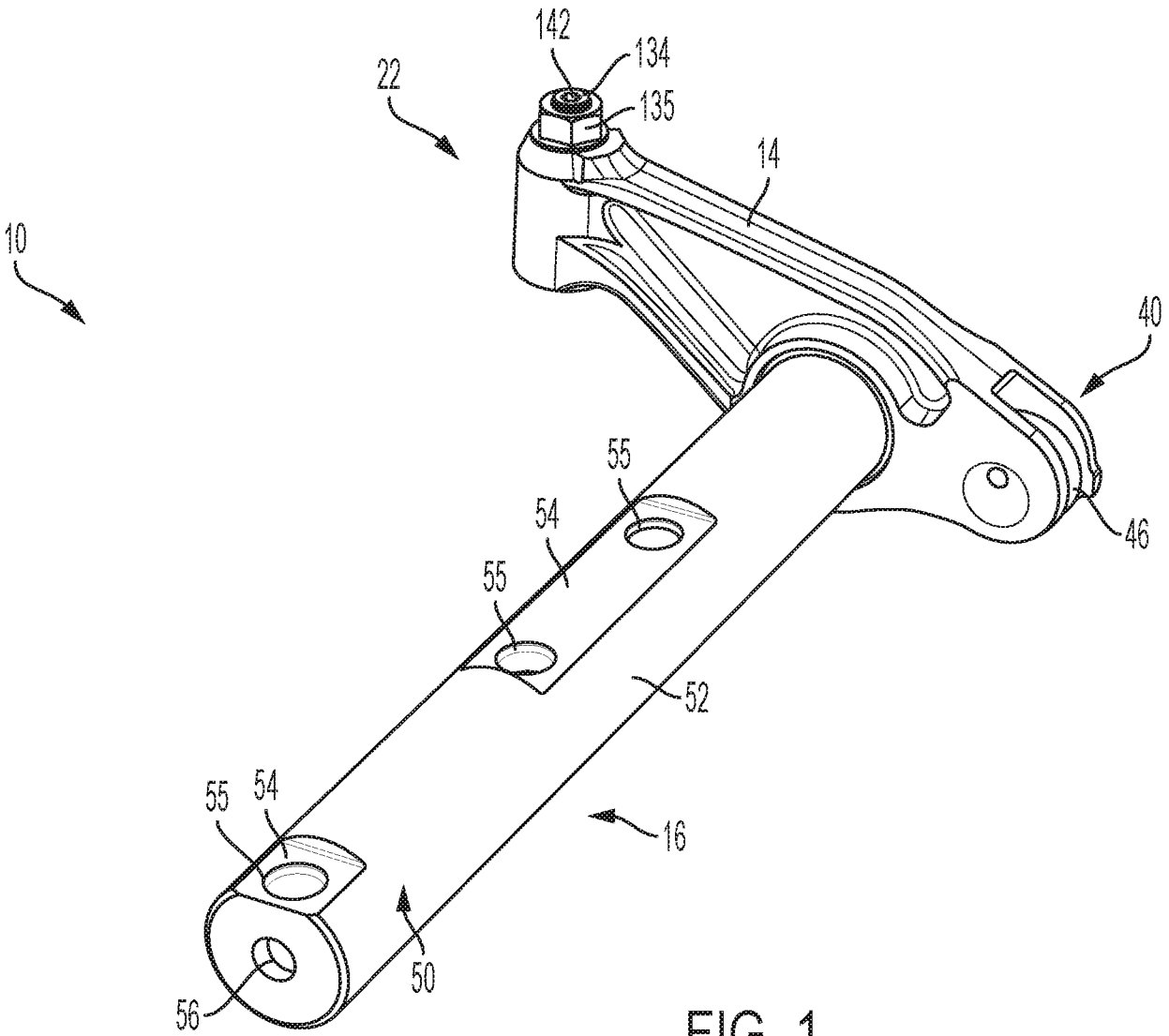
FIG. 1 is a perspective view of a portion of an exemplary embodiment of a valve actuation assembly, showing a rocker arm and a rocker shaft.
Figure 2:
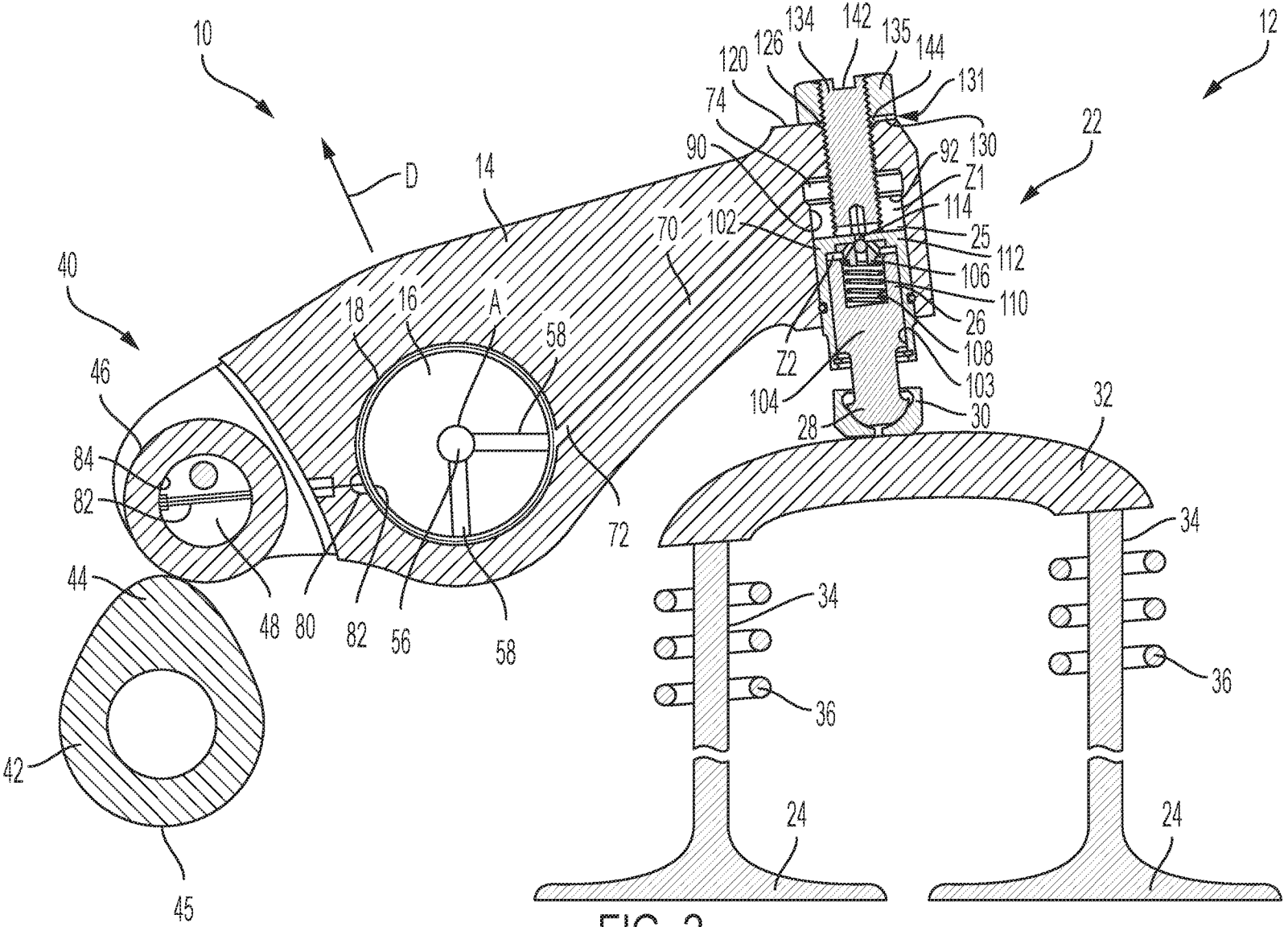
FIG. 2 is a side section view of the rocker arm and rocker shaft of FIG. 1.

FIGS. 1-5 illustrate an exemplary embodiment of rocker arm assembly 10 for a valve actuation system 12 of an internal combustion engine (not shown). The valve actuation system 12 illustrated in FIG. 2 is for an over-head cam type internal combustion engine. In other embodiments, however, the valve actuation system 12 could be configured for use in other style engines, such as pushrod type engine, for example. The rocker arm assembly 10 may be configured in a variety of ways. In the illustrated embodiment, the rocker arm assembly 10 includes a rocker arm 14, a rocker shaft 16, and a bushing 18 (FIG. 2) disposed between the rocker arm 14 and the rocker shaft 16. The rocker arm 14 is pivotably mounted on the rocker shaft 16 via a bore 20 in the rocker arm 14. The bushing 18 is seated in the bore 20 for movement with the rocker arm 14.

As shown in FIG. 2, the rocker arm 14 includes a first end 22 that is operatively coupled with a pair of engine valves 24. The first end 22 defines a HLA cavity 25 housing a hydraulic lash adjuster 26 (FIG. 2). The hydraulic lash adjuster 26 includes a pivot 28 that cooperates with a foot or pedestal 30 disposed on a valve bridge 32. The valve bridge 32 engages a pair of valve stems 34 associated with the pair of engine valves 24 to allow for rocker arm 14 to actuate the pair of engine valves 24 simultaneously. Each of the pair of engine valves 24 is biased upward by a valve spring 36 to a closed position.

The rocker arm 14 includes a second end 40 configured to receive a driving force a camshaft 42 that is coupled with a crankshaft (not shown) of the engine. The camshaft 42 defines one or more cam lobes 44 and corresponding base circle 45. The second end 40 includes a roller 46 rotatably mounted within the second end 40. The roller 46 rollably engages the cam lobe 44 such that rotation of the camshaft 42 pivots the rocker arm 14 causing the engine valves 24 to open and close.

In the illustrated embodiment, the rocker shaft 16 is an elongated rod-like body 50 extending along a longitudinal axis A and having a cylindrical outer surface 52. The outer surface 52 includes a plurality of flat portions 54 having bolt holes 55 configured to receive mounting brackets and bolts (not shown) for bolting the rocker shaft 16 to a cylinder head (not shown) of the engine. The one or more of the rocker arms 14 are configured to pivotably mount onto the rocker shaft 16. The rocker shaft 16 includes a longitudinally-extending main oil passage 56 that is in fluid communication with an oil pump (not shown) on the engine (not shown) to receive pressurized oil from the pump.

In the illustrated embodiment, the rocker shaft 16 includes a plurality of spaced apart radial oil passages 58. As illustrated in FIG. 2, the radial oil passages 58 are straight, extend radially from, and perpendicular to, the main oil passage 56. In other embodiments, however, the radial oil passages 58 may be curved, angled relative to vertical, and/or not perpendicular to the main oil passage 56.

Figure 3:
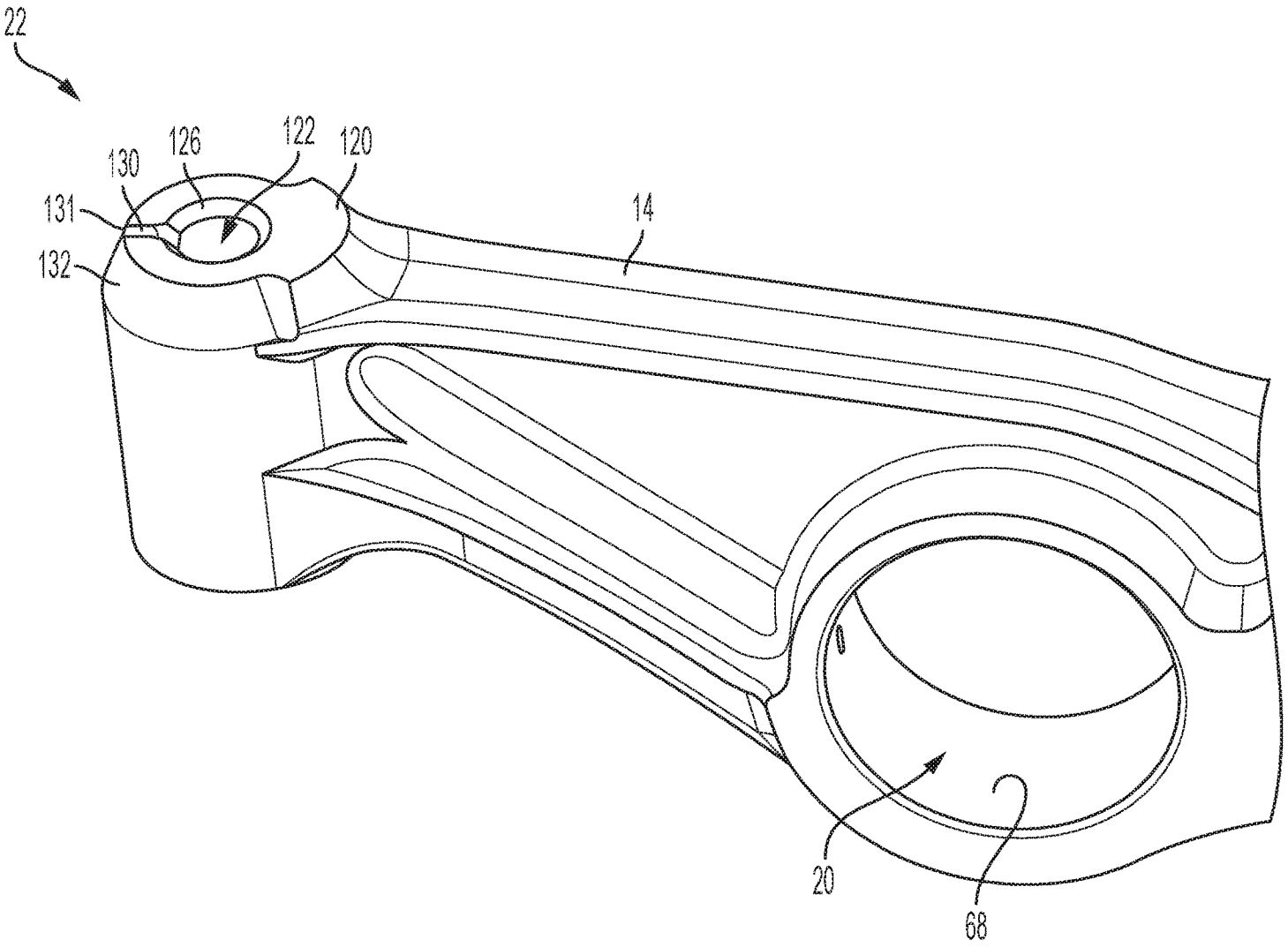
FIG. 3 is a side section view of the rocker arm of FIG. 1.

The rocker arm 14 is configured to route pressurized oil received from the main oil passage 56 of the rocker shaft 16 to the hydraulic lash adjuster 26 positioned in the first end 22 of the rocker arm 14 and to the roller 46 mounted in the second end 40 of the rocker arm 14. The bore 20 for mounting the rocker arm 14 onto the rocker shaft 16 is defined by a cylindrical inner side surface 68, as shown in FIG. 3. The roller 46 is rollably mounted onto an axle 48 in the second end 40.

Referring to FIGS. 2-3, the rocker arm 14 includes a first oil passage 70 having a first inlet 72 in the inner side surface 68. The first oil passage 70 extends from the first inlet 72 to a top portion 74 of the HLA cavity 25 to supply oil to the hydraulic lash adjuster 26. The rocker arm 14 includes a second oil passage 80 the extends from a second inlet 82 on the inner side surface 68 to a cross oil passage 81 in the axle 48. The cross oil passage 81 feeds oil to an inner surface 84 of the roller 46 to supply a layer of oil between the roller 46 and the axle 48 to reduce friction and allow the roller to rotate. In other embodiments, however, the roller 46 could be configured with roller bearings or other friction reducing means.

The hydraulic lash adjuster 26 can be any suitable hydraulic lash adjuster design. Referring to FIG. 2, the HLA cavity 25 is defined by a cylindrical inner side surface 90 and an upper surface 92 of the first end 22 of the rocker arm 14. In the exemplary embodiment of FIG. 2, the hydraulic lash adjuster 26 includes a first body member 102 disposed in the HLA cavity 25 and movable within the HLA cavity 25 relative to the first end 22 of the rocker arm 14. The first body member 102 forms a first cavity 103. A second body member 104 is disposed in the first cavity 103 and is movable within the first cavity 103 relative to the first body member 102.

The hydraulic lash adjuster 26 further includes a retainer 106 and a biasing member 108, such as for example, a spring. The biasing member 108 is positioned in a bore 110 of the second body member 104 and the retainer 106 positioned between the biasing member 108 and an upper wall 112 of the first body member 102. The biasing member 108 is configured to bias the first body member 102 away from the second body member 104 and toward the upper surface 92.

The first body member 102 includes an inlet opening 114 that is in fluid communication with the first oil passage 70 of the rocker arm 14 via the HLA cavity 25. The retainer 106 is configured to act as a check valve and is positioned in the inlet opening 114 to regulate the flow of oil through the inlet opening 114.

Figure 4:
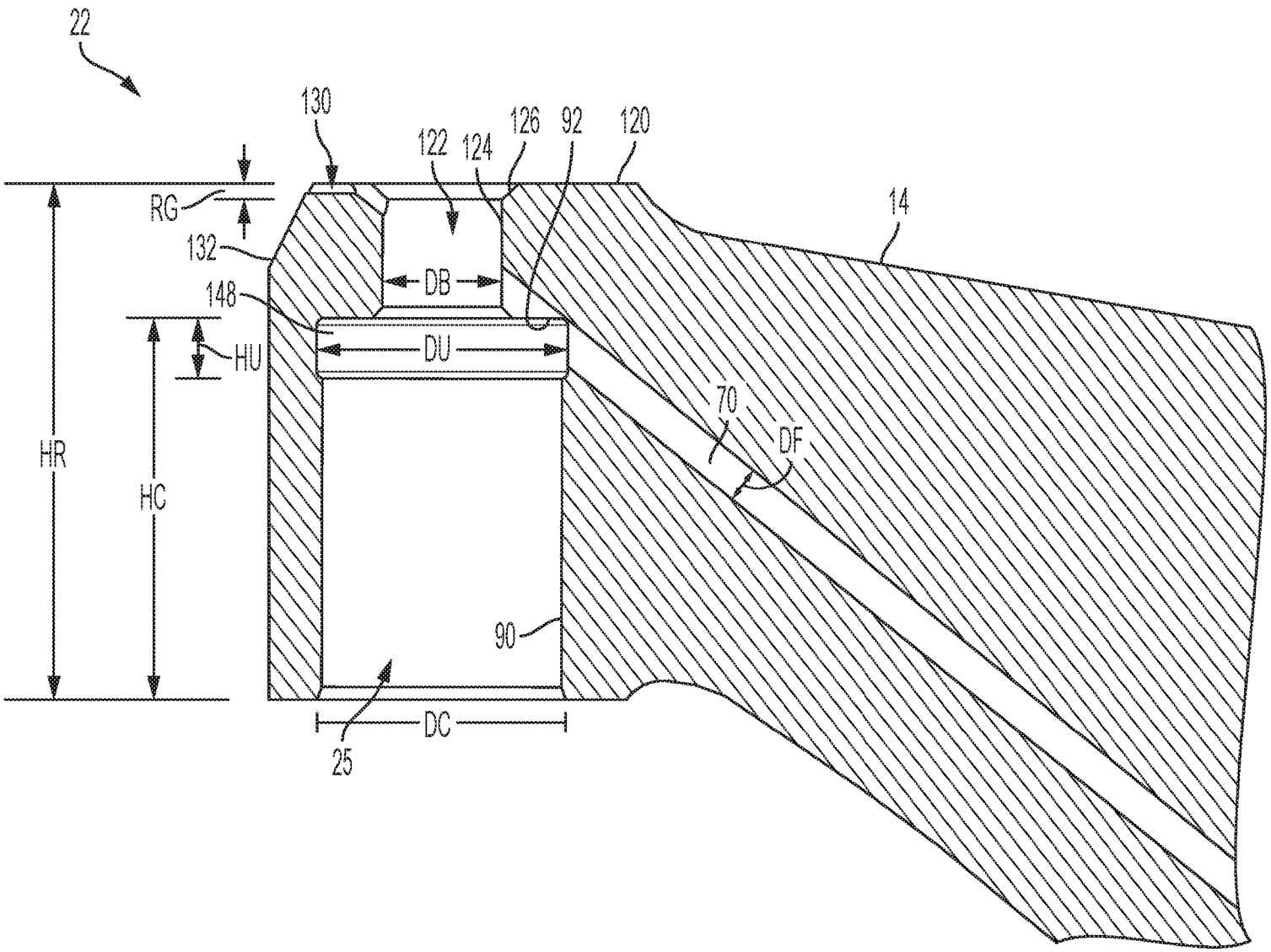
FIG. 4 is a top perspective view of the first end of the rocker arm of FIG. 1.

As shown in FIGS. 3-4, the first end 22 of the rocker arm 14 has a flat upper surface 120 and a bore 122 extending from the upper surface 120 to the HLA cavity 25. In the illustrated embodiment, the bore 122 includes a threaded portion 124 and an upper chamfered edge 126 adjacent the upper surface 120. The rocker arm assembly 10 includes one or more vent passages configured to vent air entrapped in the oil supplied to the hydraulic lash adjuster 26. The one or more vent passages may be configured in a variety of ways, including the number of vent passages and the location, the orientation, and the size of the one or more vent passages. For example, the one or more vent passages may form a flow path extending upward from the HLA cavity 25 to an area external to the rocker arm 14.

In the illustrated embodiment, the rocker arm 14 includes radial groove 130 the serves as a portion of the vent passage. The radial groove 130 has a semi-circular cross-section. In other embodiments, however, the cross-section of the radial groove 130 may be other than semi-circular, such as for example, rectangular, or other geometric configurations. The radial groove 130 extends across the upper surface 120 from the bore 122 to a vent outlet 131 at an exterior surface 132 of the first end 22 and is configured to route air and oil there between.

Figure 5:
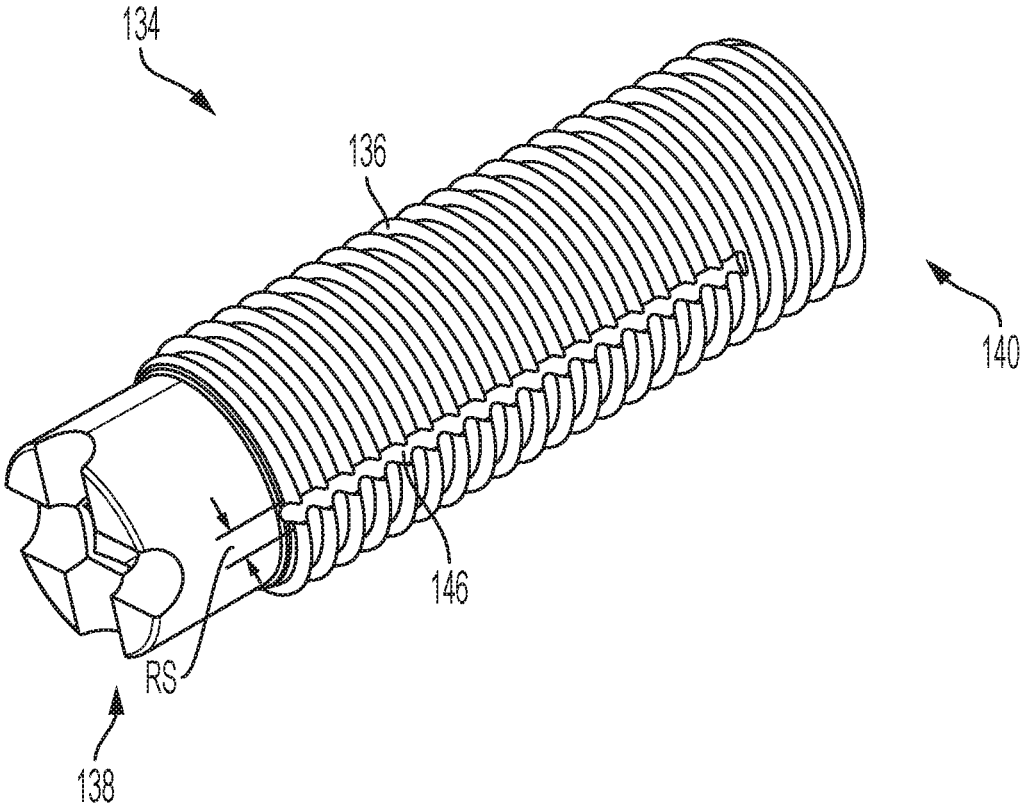
FIG. 5 is a perspective view of an exemplary embodiment of an adjustment screw of the valve actuation system of FIG. 1.

As shown in FIGS. 2 and 5, the rocker arm assembly 10 includes an adjustment screw 134 configured to be received in the bore 122 and a nut 135 for securing the adjustment screw 134 in place. The adjustment screw 134 includes an external threaded portion 136 configured to mate with the threaded portion 124 of the bore 122. The adjustment screw 134 includes a first end 138 configured to engage the first body member 102 of the hydraulic lash adjuster 26 and a second end 140 opposite the first end 138. The second end 140 extends from the upper surface 120 and includes a tool engaging portion 142 (FIGS. 1-2). The tool engaging portion 142 is configured to be engaged by a tool (not shown) for rotating the adjustment screw 134 relative to the threaded portion 124 to extend and retract the first end 138 relative to the hydraulic lash adjuster 26. The tool engaging portion 142 may be configured in a variety of ways to interact with a variety of tool types, such as for example, a hex-shaped pocket for receiving a hex key. The nut 135 is configured to threadably mate with the external threaded portion 136 and when tighten against the upper surface 120, the nut 135 and the chamfered edge 126 form the walls that define the annular cavity 144.

As shown in FIG. 5, the adjustment screw 134 includes a longitudinally extending channel 146 along at least a portion of the threaded portion 136. The channel 146 is configured to provide an oil path along the threaded portion 136, between the adjustment screw 134 and the threaded portion 124 of the bore 122, from the HLA cavity 25 to the annular cavity 144. Thus, the channel 146 in the adjustment screw 134 and the radial groove 130 in the upper surface 120 of the rocker arm 14 define the vent passage to vent air entrapped in the oil supplied to the hydraulic lash adjuster 26.

The radial groove 130 and the channel 146 are configured to allow air entrapped in oil to vent without negatively impacting the oil pressure at the inlet or inlet area to the hydraulic lash adjuster 26. For example, the size and orientation of the vent passage (i.e. radial groove 130 and the channel 146) relative to the other dimensions of the rocker assembly are selected to provide the desired venting while maintaining the desired oil pressure.

In the illustrated embodiment, the first end 22 of the rocker arm 14 has a height HR in the range of 38 mm to 47 mm, or in the range of 40 mm to 45 mm, or 42.5 mm. The HLA cavity 25 has a height HC in the range of 28 mm to 35 mm, or in the range of 31 mm to 32 mm. The HLA cavity 25 includes an upper portion 148 adjacent the upper surface 92 with a height HU in the range of 4 mm to 6 mm, or in the range of 4.5 mm to 5.5 mm, or 5 mm. The upper portion 148 has a slightly larger diameter than the rest of the HLA cavity 25. For example, in one embodiment, the upper portion 148 has a diameter DU in the range of 19 mm to 23 mm, or 21 mm and the rest of the HLA cavity 25 has a diameter DC in the range of 18 mm to 22 mm, or 20 mm.

The bore 122 has a diameter DB in the range of 10 to 13 mm, or in the range of 11 mm to 12 mm, or 11.5 mm. The radial groove 130 has a radius RG in the range of 0.5 mm to 1.5 mm, or in the range of 0.8 mm to 1.2 mm, or 1.0 mm. In some embodiments, the radial groove 130 has a radius RG in the range of 0.3 mm to 0.7 mm, or 0.5 mm. The first oil passage 70 has a diameter DF in the range of 2.5 mm or 3.5 mm, or 3.0 mm.

Referring to FIG. 5, the channel 146 extends longitudinally along the threaded portion 136 enough distance to place the HLA cavity 25 in fluid communication with the annular cavity 144. In the illustrated embodiment, the channel 146 does not extend all the way to the second end 140 of the adjustment screw 134, thus, oil flowing up the channel 146 must flow into the annular cavity 144. In the illustrated embodiment, the channel 146 has a semi-circular cross-section and has a diameter RS in the range of 0.6 mm to 1.4 mm, or in the range of 0.8 mm to 1.2 mm, or 1.0 mm. In other embodiments, however, the cross-section of the channel 146 may be other than semi-circular, such as for example, rectangular or other geometric configurations.

In other embodiments, the one or more vent passages may be configured other than by the channel 146 in the adjustment screw 134 and the radial groove 130 in the upper surface 120. For example, in one embodiment, instead of the channel 146 in the adjustment screw 134, the rocker arm 14 may include a groove (not shown) along the threaded portion 124 of the bore 122. Further, in other embodiments, instead of the radial groove 130 in the upper surface 120, a radial passage (not shown) may extend from the threaded portion 124 of the bore 122 to an exterior surface 132 of the rocker arm 14 or the nut 135 may include a passage or groove (not shown), such as for example, a radial groove adjacent the upper surface 120 extending from the annular cavity 144 to an area exterior to the rocker arm 14.

INDUSTRIAL APPLICABILITY

While the exemplary embodiments of the rocker arm assembly 10 are illustrated as used in an overhead cam type engine, the rocker arm assemblies 10 may be used in other engine types, such as for example, pushrod-type engines. The rocker arm assembly 10 is configured with one or more vent passages to vent air entrapped in the oil supplied to the hydraulic lash adjuster 26.

The one or more vent passages are configured to allow air entrapped in the oil that is being supplied to the hydraulic lash adjuster 26 to vent without negatively impacting the oil pressure at the inlet area to the hydraulic lash adjuster 26. For example, the size and orientation of the vent passage (i.e. radial groove 130 and the channel 146) relative to the other dimensions of the rocker arm assembly 10 are selected to provide a low leakage flow path that preserves system oil pressure while bleeding a low quantity of oil and trapped air. For example, in some embodiments, the radius of the radial groove 130 and/or the channel 146 may be in the range of 33% to 67% smaller than the radius of the first oil passage 70.

The rocker arm assembly 10 may also configured such that, during operation, the hydraulic lash adjuster 26 creates a small pumping action to force air and a small amount of oil through the one or more vent passages. In particular, pressurized oil from the engine oil pump (not shown) is received in the first oil passage 70 via the main oil passage 56 of the rocker shaft 16. The pressurized oil flows through the first oil passage to the HLA cavity 25 above the first body member 102. The area of the HLA cavity 25 above the upper wall 112 of the first body member 102 forms a first zone Z1, which acts as an oil reservoir for the hydraulic lash adjuster 26.

The oil supplied to the first zone Z1 flows through the inlet opening 114 in the first body member 102 to a second zone Z2 between upper wall 112 of the first body member and the second body member 104. During operation, when the second end 40 of the rocker arm 14 is following the cam lobe 44 (i.e., moving through the lift curve), the oil pressure in the second zone Z1 is greater than the oil pressure in the first zone Z1 which causes, along with the bias of the biasing member 108, the first body member 102 to be in contact with the first end 138 of the adjustment screw 134.

When the second end 40 of the rocker arm 14 is following the base circle 445 of the camshaft 42 (i.e., valve is closed), the on the hydraulic lash adjuster 26 drops and the pressure in second zone Z2 drops and equalizes with the pressure in the first zone Z1. As a result, the first body member 102 may move away from and disengage the first end 138 of the adjustment screw 134. This movement of the first body member 102 creates a pumping action in the first zone 1. This pumping action, along the system oil pressure, forces oil and air through the one or more vent passages.

In particular, the channel 146 in is fluid communication with the first zone Z1. Oil and air in the first zone Z1 are forced along the channel 146 to the annular cavity 144. Since, the annular cavity 144 circumscribes the adjustment screw 134, the annular cavity 144 places the channel 146 in fluid communication with the radial groove 130 regardless of the rotational orientation of the adjustment screw 134. The oil and air are then vented from the radial groove 130 to an area exterior to the rocker arm 14. Since the vent passage extends upward, or generally upward, air entrained in the oil will be forced through the vent passage and vented from the system.

While the present disclosure has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the present disclosure, in its broader aspects, is not limited to the specific details, the representative compositions or formulations, and illustrative examples shown and described. Accordingly, departures may be made from such details without departing from the spirit or scope of Applicant's general disclosure herein.

| Element Number | Element Name |
|---|---|
| Z1 | first zone |
| Z2 | second zone |
| 10 | rocker arm assembly |
| 12 | valve actuation system |
| 14 | rocker arm |
| 16 | rocker shaft |
| 18 | bushing |
| 20 | bore |
| 22 | first end |
| 24 | engine valves |
| 25 | HLA cavity |
| 26 | hydraulic lash adjuster |
| 28 | pivot |
| 30 | pedestal |
| 32 | valve bridge |
| 34 | valve stems |
| 36 | valve spring |
| 40 | second end |
| 42 | camshaft |
| 44 | cam lobes |
| 45 | base circle |
| 46 | roller |
| 48 | axle |
| 50 | body |
| 52 | outer surface |
| 54 | flat portions |
| 55 | bolt holes |
| 56 | main oil passage |
| 58 | radial oil passages |
| 68 | inner side surface |
| 70 | first oil passage |
| 72 | first inlet |
| 74 | top portion |
| 80 | second oil passage |
| 81 | cross oil passage |
| 82 | second inlet |
| 84 | inner surface |
| 90 | inner side surface |
| 92 | upper surface |
| 102 | first body member |
| 103 | first cavity |
| 104 | second body member |
| 106 | retainer |
| 108 | biasing member |
| 110 | bore |
| 112 | upper wall |
| 114 | inlet opening |
| 120 | flat upper surface |
| 122 | bore |
| 124 | threaded portion |
| 126 | upper chamfered edge |
| 130 | radial groove |
| 131 | vent outlet |
| 132 | exterior surface |
| 134 | adjustment screw |
| 135 | nut |
| 136 | external threaded portion |
| 138 | first end |
| 140 | second end |
| 142 | tool engaging portion |
| 144 | annular cavity |
| 146 | channel |
| 148 | upper portion |

What is claimed is:

1. A valve actuation system for an internal combustion engine, comprising:

a camshaft rotatably mounted within the internal combustion engine;

a rocker arm having a first end defining a first cavity, a second end opposite the first end, a first bore positioned between the first end and the second end, and an oil passage extending from the first bore to the first cavity;

one or more engine valves reciprocally mounted within the internal combustion engine, wherein the first end of the rocker arm is operatively coupled to the one or more engine valves;

a rocker shaft received in the first bore to pivotably mount the rocker arm onto the rocker shaft;

a hydraulic lash adjuster positioned within the first cavity, the hydraulic lash adjuster having an oil inlet in fluid communication with the oil passage;

wherein the rocker arm includes a vent passage configured to place the oil inlet in fluid communication with an area exterior to the rocker arm, wherein the rocker arm has a second bore extending from the first cavity to an upper surface thereof at the first end, wherein the vent passage extends along the second bore, wherein the adjustment screw extends through the second bore and at least partially defines the vent passage, wherein the adjustment screw includes a longitudinal channel that at least partially defines the vent passage and wherein opposite ends of the longitudinal channel are spaced from respective first and second opposite ends of the adjustment screw.

2. The valve actuation system of claim 1, further comprising a radial passage extending from the second bore to the area exterior to the rocker arm, wherein the radial passage at least partially defines the vent passage.

3. The valve actuation system of claim 2, wherein the radial passage is a groove extending across the upper surface of the rocker arm.

4. The of claim 3, wherein the groove has a first diameter and the oil passage has a second diameter that is greater than the first diameter.

5. The valve actuation system of claim 2, further comprising an annular cavity in fluid communication with the radial passage and with the first cavity.

6. The valve actuation system of claim 5, further comprising a chamfered edge circumscribing the second bore at the upper surface of the rocker arm, wherein the annular cavity is at least partially defined by the chamfered edge.

7. A rocker arm assembly for an internal combustion engine, comprising:

a rocker arm having a first end defining a first cavity, a second end opposite the first end, a first bore positioned between the first end and the second end for pivotally mounting the rocker arm within the internal combustion engine, and an oil passage extending from the first bore to the first cavity;

a hydraulic lash adjuster positioned within the first cavity, the hydraulic lash adjuster having an oil inlet in fluid communication with the oil passage; and adjustment screw;

wherein the rocker arm includes a vent passage configured to place the oil inlet in fluid communication with an area exterior to the rocker arm, wherein the first end of the rocker arm has a second bore extending from the first cavity to an upper surface of the rocker arm at the first end thereof, wherein the vent passage extends along the second bore, wherein the adjustment screw extends through the second bore and at least partially defines the vent passage, and wherein a longitudinal channel that at least partially defines the vent passage is formed in the adjustment screw, opposite ends of the longitudinal channel being spaced from respective first and second opposite ends of the adjustment screw.

* * * * *